US007155932B2

(12) United States Patent
Renter

(10) Patent No.: US 7,155,932 B2
(45) Date of Patent: Jan. 2, 2007

(54) STUD EARRING WITH A REMOVABLE DANGLING ELEMENT

(75) Inventor: Joseph G. Renter, Forest Hills, NY (US)

(73) Assignee: Kwiat, Inc., New York, NY (US)

( * ) Notice: Subject to any disclaimer, the term of this patent is extended or adjusted under 35 U.S.C. 154(b) by 0 days.

(21) Appl. No.: 10/757,336

(22) Filed: Jan. 14, 2004

(65) Prior Publication Data

US 2005/0150252 A1 Jul. 14, 2005

(51) Int. Cl.
*A44C 7/00* (2006.01)
*A44C 25/00* (2006.01)

(52) U.S. Cl. ..... 63/12; 63/13; 63/40

(58) Field of Classification Search ..... 63/26–28, 63/30–31, 12, 20, 14.9, 1.11, 40, 13; D11/75
See application file for complete search history.

(56) References Cited

U.S. PATENT DOCUMENTS

| | | | | | |
|---|---|---|---|---|---|
| 257,417 | A | * | 5/1882 | Vedder | 52/663 |
| 292,810 | A | * | 2/1884 | Hartmann | 63/12 |
| 398,787 | A | * | 2/1889 | Luthy | 24/705 |
| 758,848 | A | * | 5/1904 | Pejchar | 63/12 |
| 1,056,414 | A | * | 3/1913 | Hexter | 63/29.1 |
| D63,098 | S | * | 10/1923 | Danz | D11/44 |
| 2,691,846 | A | * | 10/1954 | Fruhling | 446/394 |
| 2,740,662 | A | * | 4/1956 | Scott | 239/55 |
| 2,792,656 | A | * | 5/1957 | Glagovsky | 24/3.1 |
| 3,418,826 | A | * | 12/1968 | Wieshuber | 63/13 |
| 3,443,398 | A | * | 5/1969 | King, Jr. | 63/13 |
| 3,605,438 | A | * | 9/1971 | Chalson | 63/20 |
| 4,086,786 | A | * | 5/1978 | Ritter | 63/13 |
| D256,003 | S | * | 7/1980 | Barr | D11/43 |
| D264,060 | S | * | 4/1982 | Epstein | D11/40 |
| 4,776,184 | A | * | 10/1988 | Hakim | 63/20 |
| 5,392,617 | A | * | 2/1995 | Baldwin | 63/12 |
| 5,577,396 | A | * | 11/1996 | Cannon | 63/13 |
| 5,588,309 | A | * | 12/1996 | Chioffe | 63/12 |
| 5,622,061 | A | * | 4/1997 | Sakata | 63/12 |
| 5,638,700 | A | * | 6/1997 | Shechter | 63/12 |
| 5,671,613 | A | * | 9/1997 | Hoover et al. | 63/27 |
| D390,151 | S | * | 2/1998 | Blum et al. | D11/40 |
| 6,508,081 | B1 | * | 1/2003 | Simpson | 63/12 |
| 2004/0083758 | A1 | * | 5/2004 | Yerushalmi | 63/26 |

* cited by examiner

*Primary Examiner*—Robert J. Sandy
*Assistant Examiner*—David Reese
(74) *Attorney, Agent, or Firm*—Steven M. Koehler; Westman, Champlin & Kelly, P.A.

(57) ABSTRACT

A jewelry design for adorning an ear which includes a conically-shaped stud mounting extending conically outward from a conical point to form a conical basket for securing a stone therein, a post with a near end attached to the conical point and a far end, and a nut engagable with the far end of the post for securing the stud mounting to the ear; a dangling element; and an intermediary connecting member which removably engages an exterior surface of the conical basket, and which includes a jump ring extending outward therefrom for flexibly supporting the dangling element so that it is removably suspendable below the stud mounting.

10 Claims, 5 Drawing Sheets

STUD EARRING WITH A REMOVABLE DANGLING ELEMENT

BACKGROUND OF THE INVENTION

The present invention relates to jewelry that adorns the ear, and more particularly, to earrings which have a top stud element attached to the ear and a bottom dangle element removably attached to the top stud element so that it dangles therefrom.

Stud earrings and earring drops which dangle therefrom have been around for a long time. The top stud element typically consists of a cylindrical basket which holds a round stone therein, a wire post attached to a circular underside of the cylindrical basket for inserting the stud into a hole in the ear, and a nut engagable with the post for securing the stud element to the ear. The cylindrical basket typically has four or six prongs which hold the stone from a top side thereof, a seat which holds the stone from a bottom side thereof, and a circular, flat base below the seat to which the prongs and the post are attached. Traditionally, there have been two ways to dangle an element off such a stud earring, either from the post or from the basket. When the dangle element is suspended from the post, it typically includes a metal protrusion which extends out from the dangle and which has a hole punched therethrough so that the post can be inserted therethrough and then through the ear hole. When the dangle element is attached to the basket, the basket typically has a loop which extends out therefrom, and the dangle has a hook which engages the loop so that the dangle is freely suspended from the top stud. Alternatively, the wire hook may be positioned on the basket and the loop on the dangle element with the same effect.

A revolution in the design of the stud basket provides for a conically shaped basket instead of the traditional cylindrical basket. The conical baskets are typically formed by either two, three, four or six wires which originate at a point and conically extend out therefrom to form the basket. The post is attached at the point where the wires meet. The conical basket arrangement permits the top stud to be inserted deeper into the ear than its cylindrical counterpart and therefore the stud does not "flip or droop over" as is typical with the cylindrical baskets. However, a compromise of the conical basket arrangement has been that it is even more difficult to removably attach a dangling element because there is less surface area to work with on the basket.

SUMMARY OF THE INVENTION

The present invention provides a jewelry design for adorning an ear which includes a conically-shaped stud mounting extending conically outward from a conical point to form a conical basket for securing a stone therein, a post with a near end attached to the conical point and a far end, and a nut engageable with the far end of the post for securing the stud mounting to the ear; a dangling element for suspension below the stud mounting; and an intermediary connecting member which engages an exterior surface of the conical basket, and which includes a jump ring extending outward therefrom for flexibly engaging the dangling element so that it is removably suspendable below the stud mounting.

DETAILED DESCRIPTION OF ILLUSTRATIVE EMBODIMENTS

Figure 1:
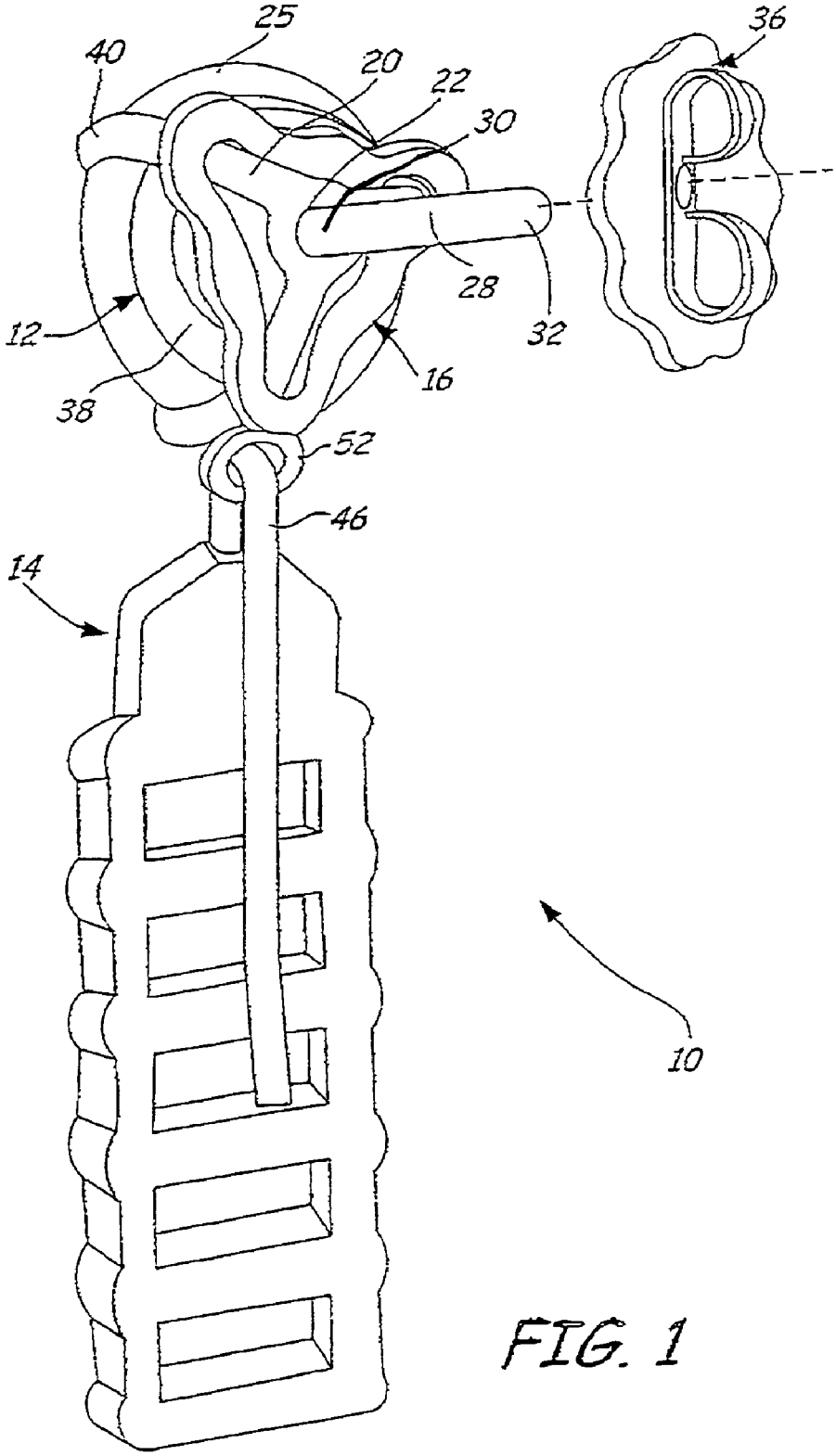
FIG. 1 is perspective view of a jewelry design, with a dangling element removably connected to the intermediary connecting member.
Figure 2:
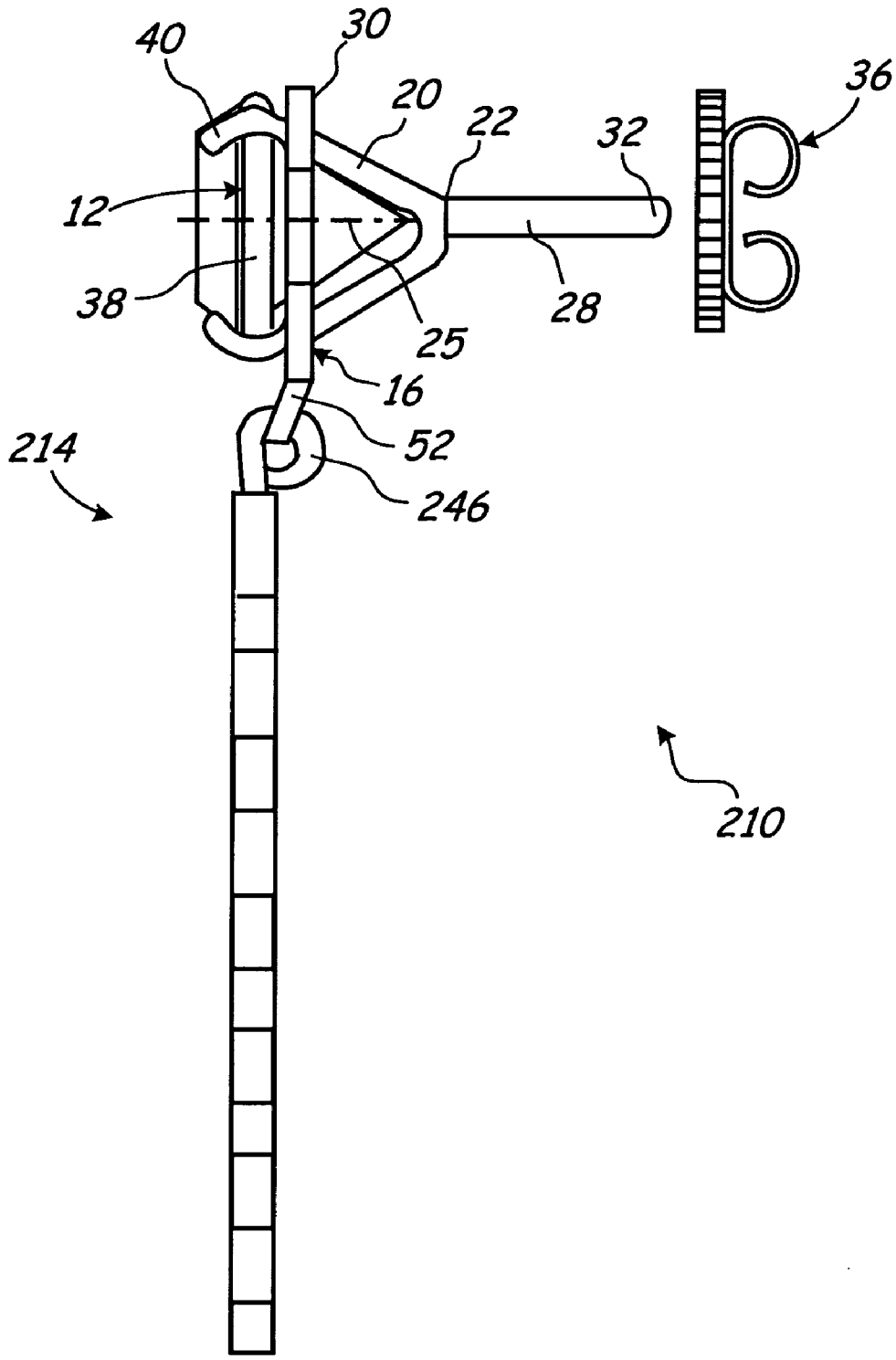
FIG. 2 is a side view of a jewelry design, with a dangling element fixedly and flexibly connected to an intermediary connecting member.
Figure 3:
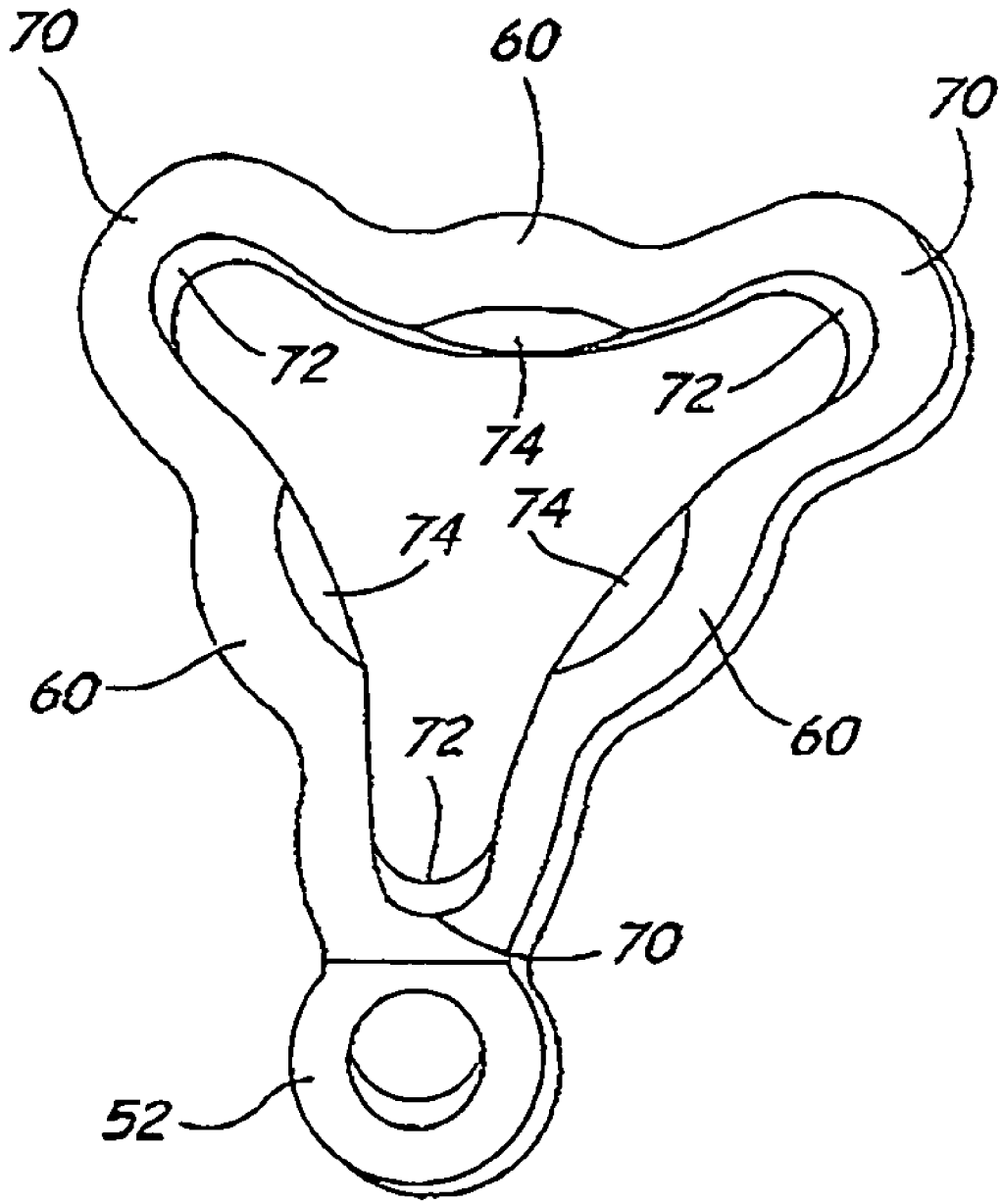
FIG. 3 is a perspective view of the intermediary connecting member shown in FIGS. 1 and 2.

FIGS. 1–3 illustrate exemplary embodiments of a jewelry design 10, 210 for adorning an ear (not shown) according to the teachings of the present invention, and which include a stud earring 12, a dangling element 14, and an intermediary connecting member 16. The jewelry designs 10, 210 are made of a precious jewelry metal such as platinum, gold or silver. The individual components are constructed by any of the well known jewelry fabrication methods including lost wax casting, stamping, or hand fabrication.

The stud earring 12 includes a conically shaped stud basket 20 having three wires extending conically and equidistantly outward from a point of attachment 22 to each other to form a conical basket for securing a round stone 25 therein. Stated another way, this embodiment, as well as the other embodiments discussed below, provides a conically-shaped basket, i.e. support, for a stone having two or more wires that extend obliquely from a common point 22. A post 28 with a near end 30 attached to the conical point 22 and a far end 32, and a nut 36 engagable with the far end 32 of the post 28 for securing the conically-shaped stud basket 20 to the ear. An optional seat 38 is shown as a wire ring attached to an inner surface of each of the three wires of the conically shaped stud basket 20. The round stone 25 is set into the conically-shaped stud basket 20 SO that it rests on the seat 38 and is secured therein by the prong ends 40 of the three wires. If the seat 38 is not used, then the stone is set against the three wires. The nut 36 frictionally engages the post 28 to secure the stud earring 12 to the ear. Other post-type engagement systems, such as, for instance, a threaded post and a screw nut may also be used.

The dangling element 14 of jewelry design 10 has a hook 46 extending therefrom. The dangling element 214 of jewelry design 210 has a wire loop or chain link 246 extending therefrom. The dangling element 14, 214 may be of any shape or size which can be supported from a persons ear lobe, provided that the wire hook 46 or wire loop 246 is accessible and flexibly attaches to the intermediary connecting member 16. If a wire hook 46 is used then the dangling element 14 is removable from the intermediary connecting member 16, while if a wire loop or chain link 246 (see FIG. 2) is used then the dangling element 214 is fixedly and flexibly attached to intermediary connecting member 16. This latter arrangement facilitates ease of use of the present invention.

The intermediary connecting member 16 permits removable flexible engagement of the conically shaped stud mounting 20 and the dangling element 14, 214. The intermediary connecting member 16 can be of any shape or size so long as it fits over the post 28 and to engage an exterior surface of one or more of the wires forming the conically-shaped stud basket 20, and so long as the intermediary connecting member 16 is disposed behind the conically-shaped stud basket 20. In this manner, the connecting member 16 is not generally visible from a frontal elevation. The intermediary connecting member 16 is thus sandwiched between the wearer's ear lobe and the stud basket 20 so as to keep the dangling element 14, 214 in proper alignment with respect to the stud basket 20.

The intermediary connecting member 16 includes a jump ring 52 and three legs 60. The jump ring 52 extends outward from the legs 60 in a downward direction for removably and flexibly engaging the wire loop or hook 46 of the dangling element 14, 214. The jump ring 52 can be angled with respect to the legs 60 so that the dangling element 14, 214 lines up with the front of the stud mounting 20. Referring specifically to FIG. 3, each of the three legs 60 is connected to the other two legs at a point 70 so as to form a triangular shape. Notches 72 can be concavely fraised at each of the three points 70 where the legs 60 are connected to each other for optimally engaging an exterior surface of a respective one of the three wires forming the conically-shaped stud basket 20. The notches 72 allow the intermediary connecting member 16 to sit closer against the stud mounting 20. A beveled area 74 can be formed at the center of each of the three legs 60 so that the intermediary connecting member 16 does not engage the stone when the intermediary connecting member 16 is sandwiched against the stud mounting 20.

Figure 4:
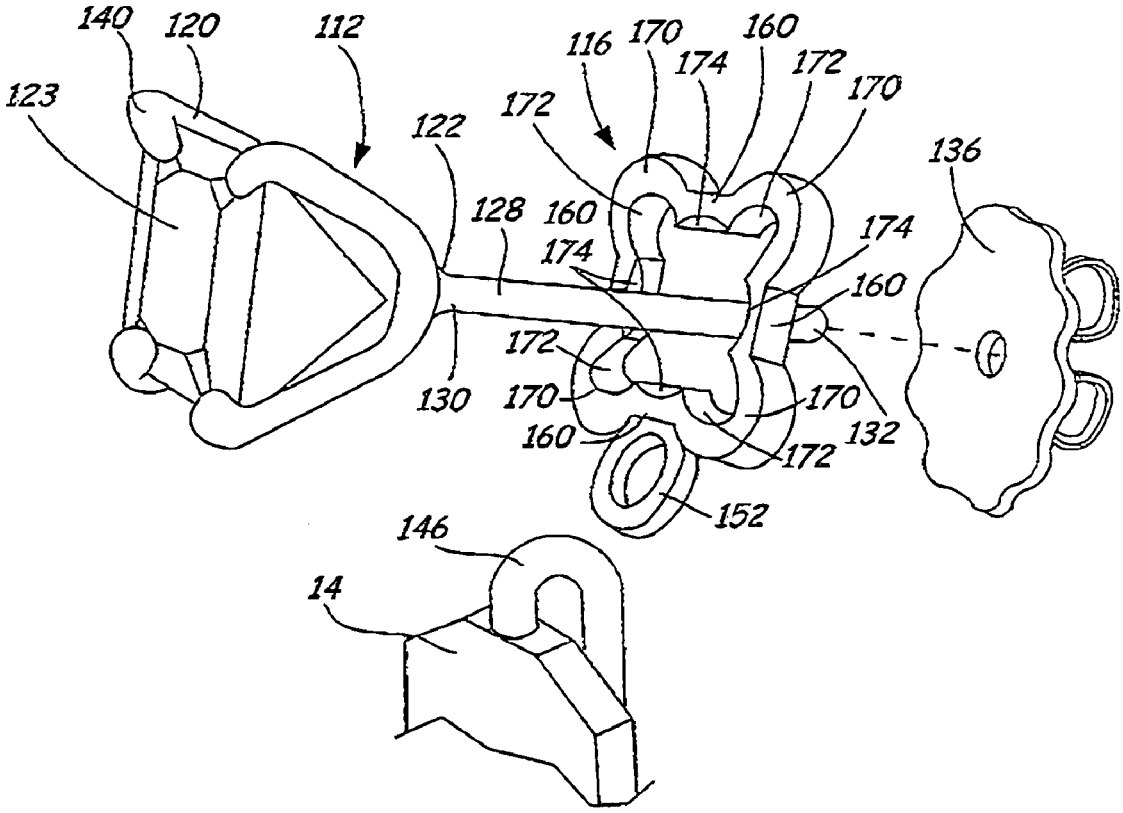
FIG. 4 is an exploded perspective view of yet another embodiment of the jewelry design according to the teachings of the present invention.

FIG. 4 illustrates a second exemplary embodiment of the present invention in which there is provided a stud earring 112, a dangling element 14, and an intermediary connecting member 116. The stud earring 112 includes a conically-shaped stud basket 120 having four wires extending conically and equidistantly outward from a point of attachment 122 to each other to form the conical basket for securing a square stone 123 therein, a post 128 with a near end 130 attached to the conical point 122 and a far end 132, and a nut 136 engagable with the far end 132 of the post 128 for securing the conically-shaped stud basket 120 to the ear. An optional seat not shown but similar to that of FIG. 1 can be integrally formed with each of the three wires of the conically shaped stud basket 120 to provide support for the square stone 123 therein. The square stone 123 is set into the conically-shaped stud basket 120 so that it rests on the seat 138 and is secured therein by the prong ends 140 of the three wires. If the seat 138 is not used, then the stone 123 is set against the four wires.

The dangling element 14 has a wire 1loop or hook 146 extending therefrom and is the same in structure and function as that shown in the first embodiment. The intermediary connecting member 116 permits removable flexible engagement of the conically shaped stud mounting 120 and the dangling element 14. The intermediary connecting member 116 is shaped to fit over the post 128 and to engage an exterior surface of each of the wires forming the conically-shaped stud basket 120 in such a way that the intermediary connecting member 116 is disposed behind the conically-shaped stud basket 120. Tn this manner, the connecting member 116 is not generally visible from a frontal elevation. The intermediary connecting member 116 is thus sandwiched between the wearer's ear lobe and the stud basket 120.

The intermediary connecting member 116 includes a jump ring 152 and four legs 160. The jump ring 152 extends outward from a midpoint of one of the legs 160 in a downward direction for removably and flexibly engaging the wire loop or hook 146 of the dangling element 114. The jump ring 152 can be angled with respect to the legs 160 30 that the dangling element 14 lines up with the front of the stud mounting 120. Each of the four legs 160 is connected to two other legs at points 170 so as to form a square shape. Notches 172 can be concavely fraised at each of the four points 170 where the legs 160 are connected to each other for optimally engaging an exterior surface of a respective one of the four wires forming the conically-shaped stud basket 120. The notches 172 allow the intermediary connecting member 116 to sit closer against the stud mounting 120. A beveled area 174 can be formed at the center of each of the four legs 160 so that the intermediary connecting member 116 does not engage the stone 123 when the intermediary connecting member 116 is sandwiched against the stud mounting 120.

Figure 5:
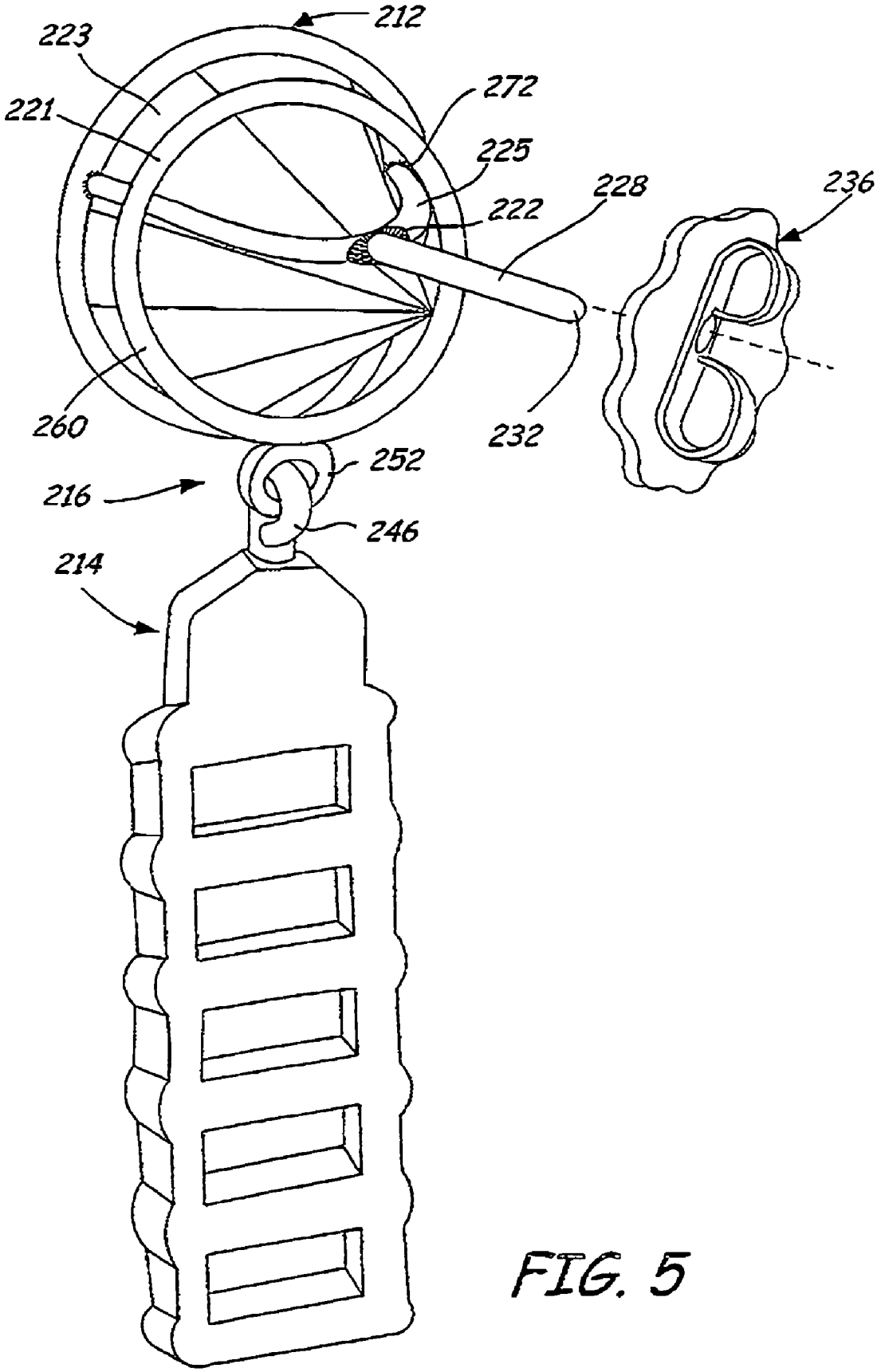
FIG. 5 is an exploded perspective view of another embodiment of the jewelry design according to the teachings of the present invention.

FIG. 5 illustrates a third exemplary embodiment of the present invention in which there is provided a stud earring 212, a dangling element 214, and an intermediary connecting member 216. The stud earring 212 includes a bezel wire 221 for securing a round stone 223 therein, a U or V-shaped (herein considered as a conically-shaped basket) support wire 225 extending out therefrom, a post 128 attached to the support wire 225 at a point of attachment 222, and a nut 236 engagable with the post 228 for securing the stud earring 212 to the ear. The dangling element 214 has a wire loop or hook 246 extending therefrom and is the same in structure and function as that shown in the proceeding embodiments. The intermediary connecting member 216 permits removable engagement of the stud earring 212 and the dangling element 214. The intermediary connecting member 216 is shaped to fit over the post 228 and to engage an exterior surface of one or more of the support wires 225 in such a way that the intermediary connecting member 216 is disposed behind the stud earring 212. In this manner, the connecting member 216 is not generally visible from a frontal elevation. The intermediary connecting member 216 is thus sandwiched between the wearer's ear lobe and the stud earring 212.

The intermediary connecting member 216 includes a jump ring 252 and a base 260. The jump ring 252 extends outward from the base 260 in a downward direction for removably and flexibly engaging the wire loop or hook 246 of the dangling element 214. The jump ring 252 can be angled with respect to the base 260 50 that the dangling element 214 lines up with the front of the stud earring 212. The base 260 is shaped so as to engage the support wire 225 while supporting the dangling element 214 in position under and adjacent to the stud earring 212. Notches 272 can be concavely fraised at the point of contact where the base 260 engages the support wire 225. The notches 272 allow the intermediary connecting member 216 to sit closer against the stud earring 212. Beveled areas (not shown) may be formed in the base 260 so that the intermediary connecting member 216 does not engage the stone 223 when the intermediary connecting member 216 is sandwiched against the stud earring 212.

In use, the hook of the dangling element is first inserted into the loop of the intermediary connecting member so that it removably and flexibly dangles therefrom. Alternatively, the loop of the intermediary connecting member is fixedly and flexibly attached to the loop of the dangling element so that it flexibly dangles therefrom. The intermediary connecting member is then inserted over the post so that it removably engages the wires of the stud basket mounting. The post is then inserted into the ear lobe of the wearer and then nut positioned on the post behind the ear lobe to secure the earring on the ear. The intermediary connecting member thereby positions the dangling element adjacent the conical stud mounting and allows the stud mounting to be worn either alone, or dressed up with any one of a variety of different dangling elements.

Although the present invention has been described with reference to particular embodiments, workers skilled in the art will recognize that changes may be made in form and detail without departing from the spirit and scope of the invention.

What is claimed is:

1. A jewelry design for adorning an ear, comprising:

a conically-shaped stud mounting extending conically outward from a conical point to form a conical basket for securing a stone therein, a post with a near end attached to the conical point and a tar end, and a nut engagable with the far end of the post for securing the stud mounting to an ear, wherein the stud mounting has at least two wires forming the conical basket;

a dangling element for suspension below the stud mounting;

an intermediary connecting member having a center aperture adapted to allow the post to be inserted therethrough and of size to allow a portion of the conical basket to also extend therethrough, wherein the intermediary connecting member removably engages the conical basket and includes legs that together surround the conical basket, and a plurality of notches, where each wire of the conical basket is removably received by a corresponding notch, and where the intermediary connecting member includes a portion for flexibly supporting the dangling element so that the dangling element is below the stud mounting.

2. A jewelry design for adorning an ear, comprising;

a conically-shaped stud mounting extending conically outward from a conical point to form a conical basket for securing a stone therein, a post with a near end attached to the conical point and a far end, and a nut engagable with the far end of the post for securing the stud mounting to an ear, wherein the stud mounting has three wires forming the conical basket;

a dangling element for suspension below the stud mounting; and an intermediary connecting member which removably engages an exterior surface of the conical basket, and which includes a portion for flexibly supporting the dangling element so that the dangling element is removably suspendable below the stud mounting, wherein the intermediary connecting member removably engages the wires forming the conical basket, and wherein the intermediary connecting member is disposed behind the stud mounting, and wherein the intermediary connecting member has three legs, each of which is connected to the other two legs at a point so as to form a triangular shape.

3. The jewelry design of claim 2, wherein the dangling element has a wire attachment extending therefrom and wherein the portion comprises a jump ring that engages the wire attachment.

4. The jewelry design of claim 2, wherein the intermediary connecting member has a notch formed at each of the three points where the legs are connected to each other for engaging a respective one of the three wires forming the conical basket.

5. The jewelry design of claim 4, wherein the intermediary connecting member has a beveled area formed in the center of each of the three legs so that the intermediary connecting member does not engage the stone when the jewelry design is worn.

6. The jewelry design of claim 3, wherein stud mounting further includes a wire seat attached to an inner surface of the conical basket and to which the stone is secured.

7. A jewelry design for adorning an ear, comprising :

a conically-shaped stud mounting extending conically outward from a conical point to form a conical basket for securing a stone therein, a post with a near end attached to the conical point and a far end, and a nut engagable with the far end of the post for securing the stud mounting to an ear, wherein the stud mounting has four wires forming the conical basket;

a dangling element for suspension below the stud mounting; and an intermediary connecting member which removably engages an exterior surface of the conical basket, and which includes a portion for flexibly supporting the dangling element so that the dangling element is removably suspendable below the stud mounting, wherein the intermediary connecting member removably engages the wires forming the conical basket, and wherein the intermediary connecting member is disposed behind the stud mounting, and wherein the intermediary connecting member has four legs, each of which is connected to two legs at a point so as to form a square shape.

8. The jewelry design of claim 7, wherein the intermediary connecting member has a notch formed at each of the four points where the legs are connected to each other for engaging a respective one of the four wires forming the conical basket.

9. The jewelry design of claim 8, wherein the intermediary connecting member has a beveled area formed in the center of each of the four legs so that the intermediary connecting member does not engage the stone when the jewelry design is worn.

10. The jewelry design of claim 1, wherein the intermediary connecting member engages the wires so as to inhibit rotation of the intermediary connecting member relative to the conical basket.

* * * * *